United States Patent [19]

Ringgenberg

[11] Patent Number: 4,694,903

[45] Date of Patent: Sep. 22, 1987

[54] FLAPPER TYPE ANNULUS PRESSURE RESPONSIVE TUBING TESTER VALVE

[75] Inventor: Paul D. Ringgenberg, Duncan, Okla.

[73] Assignee: Halliburton Company, Duncan, Okla.

[21] Appl. No.: 876,967

[22] Filed: Jun. 20, 1986

[51] Int. Cl.[4] ..... E21B 47/10; E21B 34/10

[52] U.S. Cl. ..... 166/250; 73/40.5 R; 166/317; 166/323; 166/374; 166/386

[58] Field of Search ..... 166/250, 374, 386, 142, 166/317, 319, 321, 323, 325, 332; 73/40.5 R

[56] References Cited

U.S. PATENT DOCUMENTS

| | | | |
|---|---|---|---|
| 2,742,093 | 4/1956 | Vaughn | 166/224 |
| 3,329,007 | 7/1967 | Conrad | 73/40.5 R |
| 3,332,495 | 7/1967 | Young | 166/148 |
| 3,470,903 | 10/1969 | Scott | 137/467 |
| 3,779,263 | 12/1973 | Edwards et al. | 166/374 X |
| 4,100,969 | 7/1978 | Randermann | 166/324 |
| 4,122,898 | 10/1978 | Nelson | 166/325 |
| 4,161,985 | 7/1979 | Fournier et al. | 166/321 |
| 4,295,361 | 10/1981 | McMahan | 73/40.5 R |
| 4,319,633 | 3/1982 | McMahan | 166/250 |
| 4,319,634 | 3/1982 | McMahan | 166/250 |
| 4,421,172 | 12/1983 | McMahan | 166/334 |
| 4,458,762 | 7/1984 | McMahan | 166/373 |
| 4,475,599 | 10/1974 | Akkerman | 166/323 |
| 4,609,005 | 9/1986 | Upchurch | 166/317 X |

OTHER PUBLICATIONS

Publication by Baker Oil Tools on a Model "S" Full-Bore Tubing Tester, dated Sep. 15, 1975.

*Primary Examiner*—Stephen J. Novosad
*Assistant Examiner*—Hoang C. Dang
*Attorney, Agent, or Firm*—James R. Duzan; Joseph A. Walkowski

[57] ABSTRACT

The tubing tester valve of the present invention comprises a tubular housing assembly having a downwardly closing, spring biased flapper valve disposed therein near the top thereof. A tubular mandrel assembly is disposed within the housing assembly below the flapper valve, and is secured to the housing assembly with shear pins. The tubing tester valve may be permanently opened through the application of annulus pressure from the rig floor to the annulus surrounding the pipe string, which pressure moves the mandrel assembly upward to rotate the flapper valve to an open position. In order to assure that the mandrel assembly does not retract downwardly, thus permitting the flapper valve to reclose, a spring biased locking means is provided to hold the mandrel assembly in its "up" position.

2 Claims, 7 Drawing Figures

FLAPPER TYPE ANNULUS PRESSURE RESPONSIVE TUBING TESTER VALVE

BACKGROUND OF THE INVENTION

The present invention relates generally to valve apparatus used in a string of tubing or drill pipe disposed in a well bore, and particularly to a new and improved type of tubing tester valve which may be incorporated in a string of tubing or drill pipe being run into a well bore and employed to pressure test the integrity of the string.

Numerous well service operations entail running a packer into a well bore at the end of a string of tubing or drill pipe, and setting the packer to isolate a producing formation or "zone" intersected by the well bore from the well bore annulus above the packer. After this isolation procedure, a substance such as a cement slurry, an acid or other fluid is pumped through the tubing or drill pipe under pressure and into the formation behind the well bore casing through perforations therethrough in an area below the packer. One major factor in ensuring the success of such an operation is to have a pressure-tight string of tubing or drill pipe.

Another common well service operation in which it is desirable to assure the pressure integrity of the string of tubing or drill pipe is the so-called drill stem test. Briefly, in such a test, a testing string is lowered into the well to test the production capabilities of the hydrocarbon producing underground formations or zones intersected by the well bore. The testing is accomplished by lowering a string of pipe, generally drill pipe, into the well with a packer attached to the string at its lower end. Once the test string is lowered to the desired final position, the packer is set to seal off the annulus between the test string and the well casing, and the underground formation is allowed to produce oil or gas through the test string. As with the previously mentioned well service operations, it is desirable prior to conducting a drill stem test, to be able to pressure test the string of drill pipe periodically so as to determine whether there is any leakage at the joints between successive stands of pipe.

To accomplish this drill pipe pressure testing, the pipe string is filled with a fluid and the lowering the pipe is periodically stopped. When the lowering of the pipe is stopped, the fluid in the string of drill pipe is pressurized to determine whether there are any leaks in the drill pipe above a point near the packer at the end of the string.

In the past, a number of devices have been used to test the pressure integrity of the pipe string. In some instances, a closed formation tester valve included in the string is used as the valve against which pressure thereabove in the testing string is applied. In other instances, a so-called tubing tester valve is employed in the string near the packer, and pressure is applied against the valve element in the tubing tester valve.

As it is necessary to fill the tubing or drill pipe string with an incompressible fluid as the string is run into the well bore before applying pressure to the interior of the string. Some prior art tubing tester valves, when used in a string without a closed formation tester valve therebelow, rely upon the upward biasing of a flapper valve element against a spring by hydrostatic pressure below the tubing tester valve in the test string to gradually fill the test string from below with fluid in the well bore, generally drilling "mud." In other instances, the test string is filled from the top on the rig floor with diesel oil or other fluids, such a procedure being easily appreciated as time consuming and hazardous. Still other prior art tubing tester valves incorporate a closeable bypass port below the valve element so that, even with a closed formation tester valve below, well fluids in the annulus surrounding the test string can enter in the vicinity of the tubing tester valve and bias a valve element therein to an open position through hydrostatic pressure, thereby filling the string.

At some point during the well service operation, be it cementing, treating or testing, it is necessary to be able to open the tubing tester valve so that flow from the rig floor down into the formation, which would normally close the valve, may be effected. Prior art tubing tester valves accommodate this necessity in several ways. Some valves provide for the opening of the tubing tester valve through reciprocation and/or rotation of the pipe string, while other prior art valves provide for the opening of the valve through a valve actuator operated responsive to an increase in annulus pressure.

The form that the valve element in prior art tubing tester valves may take has also been varied. Ball valves, flapper valves, and even sleeve valves, where it is not necessary or desirable to have a fully open bore from the top of the pipe string to the bottom, have been employed.

All of the prior art tubing tester valves, however, have suffered from various deficiencies relating to the complexity of their operating mechanisms, or from a necessity to reciprocate or otherwise move the pipe string in order to open a valve element therein against flow from the surface to a formation below the packer.

SUMMARY OF THE INVENTION

The present invention, in contrast to the prior art, provides a relatively simple, reliable, annulus pressure responsive tubing tester valve having applicability to any of the aforementioned well service operations. The tubing tester valve of the present invention comprises a tubular housing assembly having a downwardly closing, spring biased flapper valve disposed therein near the top thereof. A tubular mandrel assembly is disposed within the housing assembly below the flapper valve, and is secured to the housing assembly with shear pins.

When the tubing tester valve of the present invention is incorporated into a pipe string run into a well bore, hydrostatic pressure from below the tool will cause the valve flapper to bias upwardly away from its cooperating valve seat, thereby permitting the pipe string above the tubing tester valve to become filled with well bore fluid. As the hydrostatic pressure above and below the flapper valve equalizes, the flapper will again close, thus permitting pressure testing of the string whenever desired within a few moments of halting the string's descent into the well bore. In such a manner, the string can be easily pressure tested after the attachment of every few stands of pipe, and any leak in the joints therebetween located and corrected in a timely manner. As the pipe string reaches the test or treatment depth in the well bore, the tubing tester valve of the present invention may be permanently opened through the application of annulus pressure to the annulus surrounding the pipe string from the rig floor.

When pressure is applied to open the valve, the increased pressure enters the tubular housing assembly of the tool through a plurality of ports extending through the wall thereof. This increased pressure acts on an enlarged portion of the mandrel assembly which acts as a piston, due to the inclusion of pressure-tight seals between the housing and mandrel assemblies. When the applied pressure exceeds the shear strength of the aforementioned shear pins, the mandrel assembly will move upwardly in the housing assembly and contact the valve flapper of the flapper valve assembly, biasing it in a rotational manner upwardly into a position where it is moved out of the flow path through the tubing tester valve into a recess in the housing assembly. In order to assure that the mandrel assembly does not retract downwardly, thus permitting the flapper valve to reclose, a spring biased locking means is provided to hold the mandrel assembly in its "up" position. This locking means comprises, in the preferred embodiment, a plurality of locking dog segments disposed in cavities inside the housing assembly, and biased inwardly against the lower portion of the mandrel assembly. When the mandrel assembly moves to its fully extended upward position, opening the valve flapper, the locking dog segments move into an annular recess near the bottom of the mandrel assembly and are maintained therein through the biasing actions of surrounding O-rings.

BRIEF DESCRIPTION OF THE DRAWINGS

Numerous features and advantages of the present invention will be readily apparent to those of ordinary skill in the art upon a reading of the following detailed description of the preferred embodiment of the present invention, taken in conjunction with the accompanying drawings, wherein.

OVERALL WELL TESTING ENVIRONMENT

Figure 1:
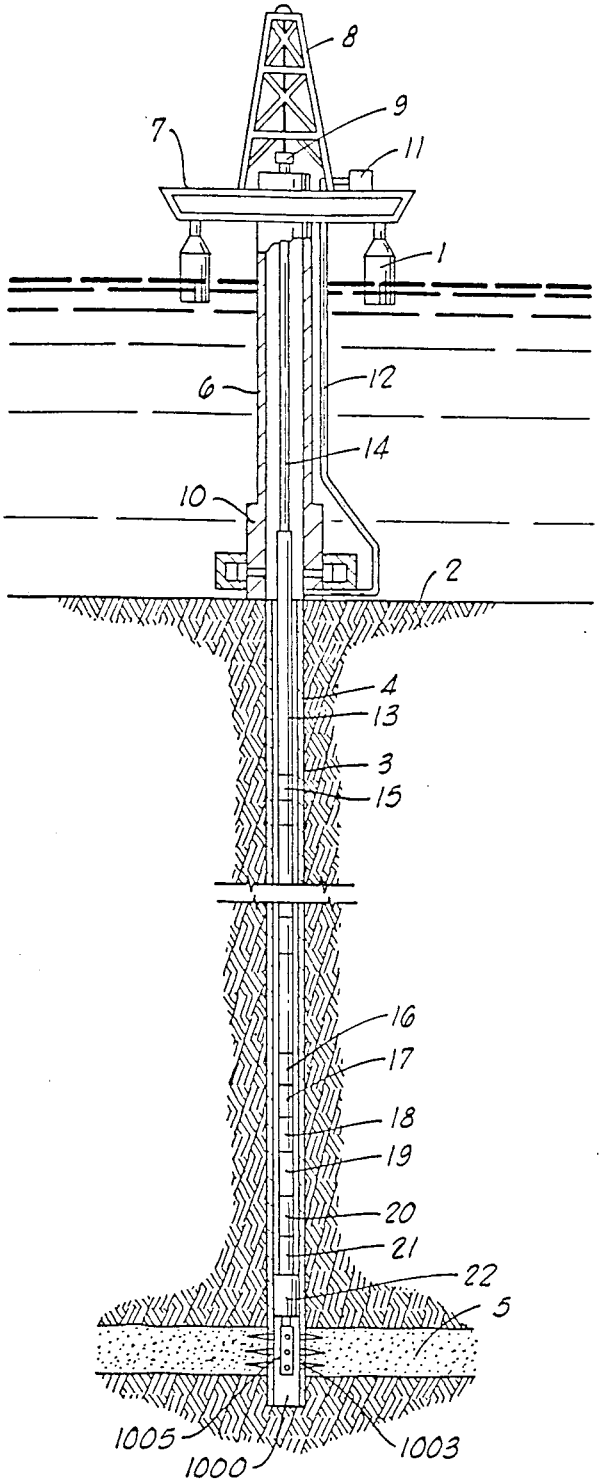
FIG. 1 is a schematic illustration of a well test string for an offshore well in which the tubing tester valve of the present invention may be disposed.

Referring to FIG. 1 of the drawings, a testing string for use in an offshore oil or gas well is schematically illustrated therein.

In FIG. 1, a floating working station 1 is centered over a submerged oil or gas well located in the sea floor 2 having a well bore 3 which extends from the sea floor 2 to a submerged formation 5 to be tested. The well bore 3 is typically lined by steel casing 4 cemented into place. A subsea conduit 6 extends from the deck 7 of the floating work station 1 into a well head installation 10. The floating work station 1 has a derrick 8 and a hoisting apparatus 9 for raising and lowering tools to drill, test, and complete the oil or gas well. A testing string 14 is being lowered into the well bore 3 of the oil or gas well. The testing string includes such tools as one or more pressure balanced slip joints 15 to compensate for the wave action of the floating work station 1 as the testing string is being lowered into place, a circulation valve 16, a tubing tester valve 17 of the present invention, a formation tester valve 18, and a sampler valve 19.

The slip joint 15 may be similar to that described in U.S. Pat. No. 3,354,950 to Hyde. The circulation valve 16 is preferably of the annulus pressure responsive type and may be as described in U.S. Pat. Nos. 3,850,250 or 3,970,147. The circulation valve 16 may also be of the recloseable type described in U.S. Pat. No. 4,113,012 to Evans et al.

The tester valve 18 is preferably of the annulus pressure responsive type, and being further described as the type with the capability to be run into the well bore in an open position. Such valves are known in the art, and are described in co-pending U.S. patent application Ser. No. 752,210, now U.S. Pat. No. 4,655,288, assigned to the assignee of the present invention.

The sampler valve 19 is preferable of the annulus pressure responsive type having a full open bore therethrough, as described in co-pending U.S. patent application Ser. No. 848,428, now U.S. Pat. No. 4,665,983 assigned to the assignee of the present invention.

As shown in FIG. 1, the circulation valve 16, tubing tester valve 17, formation tester valve 18, and sampler valve 19, are operated by fluid annulus pressure exerted by a pump 11 on the deck of the floating work station 1. Pressure changes are transmitted by pipe 12 to the well annulus 13 between the casing 4 and the testing string 14. Well annulus pressure is isolated from the formation 5 to be tested by a packer 21 having expandable sealing element 22 thereabout set in the well casing 4 just above the formation 5. The packer 21 may be a Baker Oil Tools Model D packer, the Otis Engineering Corporation Type W packer, the Halliburton Services EZ Drill® SV, RTTS or CHAMP® packers or other packers well known in the well testing art.

The testing string 14 may also include a tubing seal assembly 20 at the lower end of the testing string which "stings" into or stabs through a passageway through packer 21 if such is a production packer set prior to running testing string 14 into the well bore. Tubing seal assembly 20 forms a seal with packer 21 isolating the well annulus 13 above the packer from an interior bore portion 1000 of the well immediately adjacent the formation 5 and below the packer 21.

Check valve 20 relieves pressure built up in testing string 14 as seal assembly 21 stabs into packer 22.

A perforating gun 1005 may be run via wireline or may be disposed on a tubing string at the lower end of testing string 14 to form perforations 1003 in casing 4, thereby allowing formation fluids to flow from the formation 5 into the flow passage of the testing string 14 via perforations 1003. Alternatively, the casing 4 may have been perforated prior to running test string 14 into the well bore 3.

As previously noted, the tubing tester valve of the present invention may be used to pressure test string 14 as it is lowered into the well. As test depth is reached, pressure in annulus 13 is increased by pump 11 through conduit 12, whereupon tubing tester valve 17 is locked into an open position.

A formation test controlling the flow of fluid from the formation 5 through the flow channel in the testing string 14 may then be conducted by applying and releasing fluid annulus pressure to the well annulus 13 by pump 11 to operate circulation valve 16, formation tester valve 18 and sampler valve 19, accompanied by measuring of the pressure buildup curves and fluid temperature curves with appropriate pressure and temperature sensors in the testing string 14, all as fully described in the aforementioned patents.

It should be understood, as noted previously, that the tubing tester valve of the present invention is not limited to use in a testing string as shown in FIG. 1, or even to use in well testing per se. For example, the tubing tester valve of the present invention may be employed in a drill stem test wherein no other valves, or fewer valves than are shown in FIG. 1, are employed. In fact, the valve of the present invention may be employed in a test wherein all pressure shut-offs are conducted on the surface at the rig floor, and no "formation tester" valves are used at all. Similarly, in a cementing, acidizing, fracturing or other well service operation, the tubing tester valve of the present invention may be employed whenever it is necessary or desirable to assure the pressure integrity of a string of tubing or drill pipe.

DETAILED DESCRIPTION OF THE PREFERRED EMBODIMENT

Tubing tester valve 17 of the preferred embodiment of the present invention generally comprises a tubular housing assembly 100 surrounding a tubular mandrel 102.

The top of housing assembly 100 comprises valve case 110, having a cylindrical exterior 112. At the upper end of valve case 110, entry bore 114 having threaded wall 116 provides a means by which a string of tubing or drill pipe may be secured to the top of tubing tester valve 17. Below threaded wall 116, frustoconical surface 118 leads to cylindrical entry bore 120, below which outwardly beveled annular edge 122 extends to a larger mandrel receptacle bore 124. Below bore 124, downwardly and outwardly extending frustoconical surface 126 leads to cylindrical valve flapper bore 128, bore 128 extending to the bottom of valve housing 110, where valve case 110 is secured to valve support housing 130 at threaded connection 132. Valve support housing 130 extends upwardly into bore 128 of case 110 in a telescoping manner. Valve flapper 136 of circular configuration is disposed in a recess 138 (see FIG. 3A) at the top of valve support housing 130. Valve flapper 136 possesses two laterally extending legs 140, which, with pin 142 extending therethrough and through upright pin support 143 at the top of valve support housing 130, form a hinge assembly 145 permitting valve flapper 136 to rotate upwardly into valve chamber 144 (see FIG. 3A) defined by bore wall 128. Valve flapper 136 is normally biased in a rotationally downward direction by a spring 137, as is generally known in the art.

In its normally closed or downwardly biased position, valve flapper 136 rests against ring-shaped valve seat 146, the top annular edge 148 of which provides a surface for the lower surface 150 of valve flapper 136 to seal against. Valve seat 146 is disposed in valve seat bore 152 near the top of valve support housing 130, and is supported from below by annular shoulder 154.

A plurality of radially oriented threaded holes 156 extend through the wall of valve support housing 130 between valve seat bore 152 and cylindrical exterior leading surface 158 above seal assembly 160 disposed about valve seat 146 in bore 152. Allen screws (not shown) threaded into holes 156 bear against valve seat 146 and keep same from being pumped or sucked out of valve support housing 130 when valve flapper opens. Another seal assembly 162 seals between the exterior of valve support housing 130 disposed inside of housing 110, and bore wall 128 of housing 110.

Below the connection 132, valve support housing 130 possesses a generally cylindrical surface 166 which extends to the lower end thereof. On the interior of valve support housing 130, mandrel orientation bore 168 extends downwardly below shoulder 152, stepping to a larger, lower bore 170 at step 172. At the same side of mandrel orientation bore 168 as the valve flapper hinge assembly is located, longitudinally extending key 174 protrudes radially inwardly from the wall of mandrel orientation bore 168.

Below enlarged bore 170, beveled annular surface 176 extends outwardly to cylindrical piston bore 178, which in turn extends downwardly to slightly outwardly tapered surface 180 and cylindrical locking assembly bore 182. A plurality of radially oriented pressure ports 184 extend through the wall of valve support housing 130 immediately below tapered bore 180.

Lower adapter 190 is secured at threaded connection 188 to valve support housing 130. The lower exterior 192 of lower adapter 190 is generally of cylindrical configuration, and extends to the lower end of lower adapter 190 whereat radially inwardly extending shoulder 194 leads to seal recess 196, below which extend male threads 198 by which additional components may be added to the pipe string below tubing tester valve 17 of the present invention. A seal assembly (not shown) may be disposed in recess 196 to assure a fluid-tight seal between tubing tester valve 17 and the next lower component.

Figure 5:
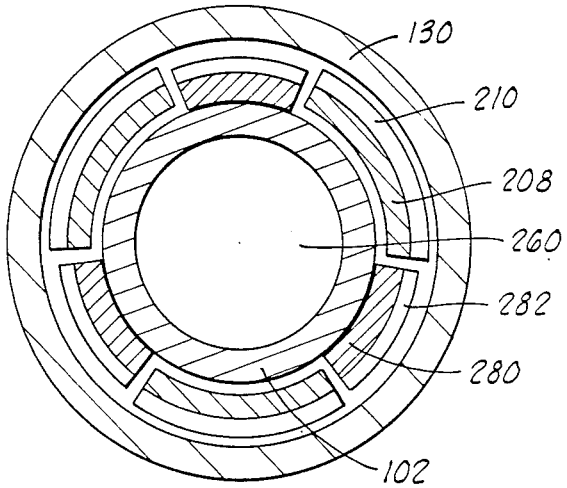
FIG. 5 is a section taken across lines 5—5 in FIG. 3B.

The upper portion 200 of lower adapter 190 is received inside of valve support housing 130, and includes a plurality of shear pin holes 202, the outer extents of which are intersected by a circumferential groove (unnumbered). Below holes 202, a plurality of circumferential windows 206 extend through the wall of lower adapter 190, windows 206 having webs 208 extending therebetween, webs 208 having segmented annular channel 210 on their exteriors (see FIG. 5).

The upper portion 200 of lower adapter 190 possesses an enlarged shear pin bore 212, which necks down slightly to lower mandrel bore 214, which terminates at tapered shoulder 216 leading to exit bore 218.

Tubular mandrel 102 includes several distinct sections, the first being relatively thin-walled valve actuation section 220 at the top thereof. Section 220 is of slightly lesser outer diameter than valve orientation bore 168, and its upper end is defined by arcuate edge 222, running from its highest extent diametrically opposite to the flapper hinge assembly 145, and curving downward to its lowest extent on the same side of the tool as the hinge assembly 145. A longitudinally extending slot 224 is cut through the wall of section 220 in order to accommodate key 174 extending inwardly thereinto from mandrel orientation bore 168, thus preventing rotation of mandrel 102 with respect to housing assembly 100.

At the lower extent of valve actuation section 220, mandrel piston section 230 extends outwardly therefrom. It should be understood that the inner diameter 226 of mandrel 102 is constant from the top thereof until it reaches flared exit bore 228 at the very bottom thereof. On the other hand, the outer diameter of piston section 230 is defined by leading beveled surface 232, terminating at cylindrical step 234, which is in turn followed by chamfered annular edge 236. Below edge 236, cylindrical piston seal surface 238 extends downwardly to inwardly chamfered edge 240, trailing piston surface 242, and downwardly facing annular shoulder 244, terminating in shear pin step 246. Below shear pin step 246, trailing cylindrical surface 248 of slightly lesser diameter extends downwardly to the lower end of mandrel 102. Extended circumferential annular locking groove 250 cut in surface 248 lies near the lower end of mandrel 102, below which seal assembly 252 is disposed in a recess (unnumbered) in surface 248 to form a sliding, pressure-tight seal between mandrel 102 and lower adapter 190.

Returning to the upper end of piston section 230, seal assembly 254 disposed in a circumferential groove (unnumbered) in piston seal surface 238 provides a sliding, pressure-tight seal between mandrel 102 and valve support housing 130.

A piston cavity 256 of variable volume is defined between the inside of valve support housing 130 and the outside of mandrel 102 above piston section 230. This cavity shortens as mandrel 102 moves upwardly in housing assembly 100, and fluid in cavity 256 is expelled into bore 260 of mandrel 102 through apertures 258 during such movement.

Figure 2A:
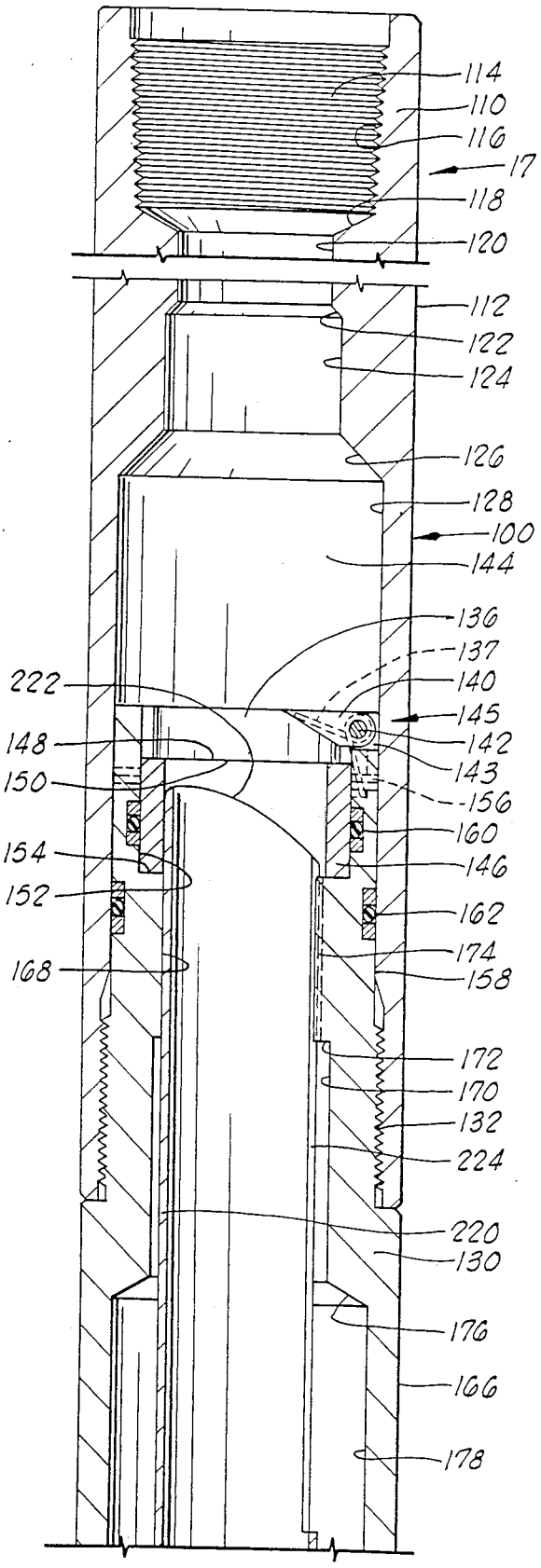
FIGS. 2A and 2B are half-section vertical elevations of a preferred embodiment of the tubing tester valve of the present invention, shown in its initial position as it would be run into a well bore as part of a pipe string.
Figure 2B:
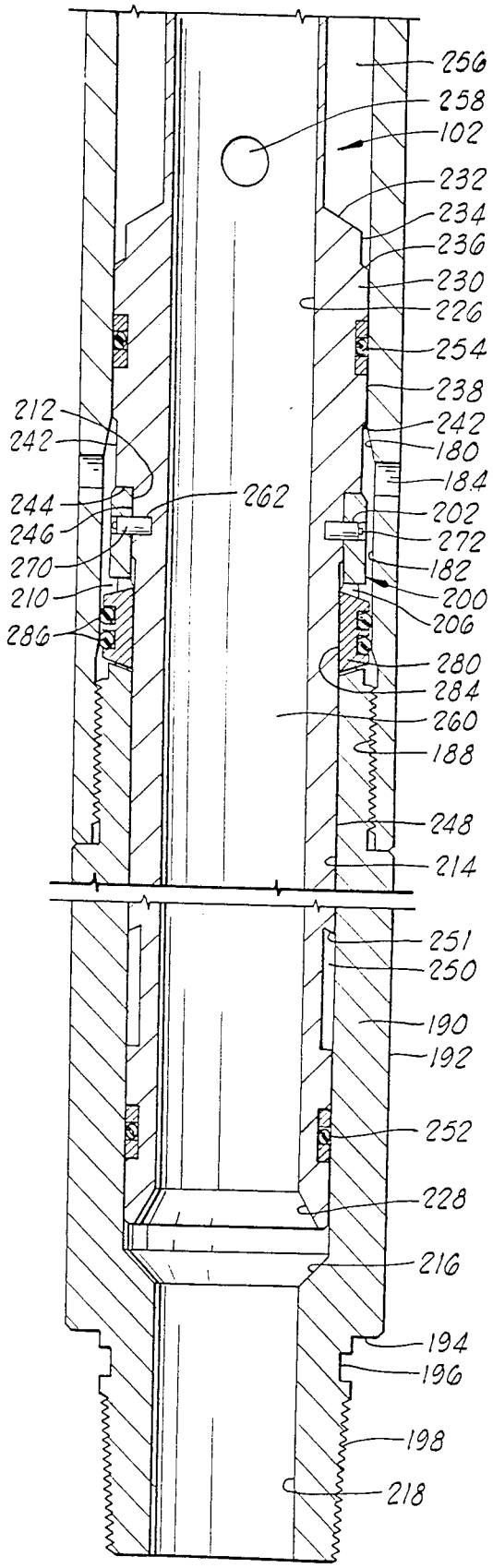

Referring again to FIG. 2B, a plurality of shear pins 270 are disposed in holes 202 in upper portion 200 of lower adapter 190, extending into matching circumferential shear pin groove 262 in the exterior of mandrel 102 through shear pin step 246. Shear pins 270 are maintained in place by O-ring 272. With shear pins 270 in place, upper portion 200 of lower adapter 190 abuts downwardly facing annular shoulder 244 on mandrel 102.

A plurality of locking dogs 280, of generally trapezoidal cross-section, are disposed in windows 206 in lower adapter 190. Locking dogs 280 have several lateral grooves 282 cut in their exteriors, while their interior surfaces 284 are of arcuate configuration and of substantially the same radius as the bottom of locking groove 250. O-rings or garter springs 286 are disposed in the locking dog grooves 282 and extend about mandrel 102 on the exterior of webs 208, residing in channels 210 (O-rings/springs 284 not shown in FIG. 5), whereby a strong radially inward force is exerted upon locking dogs 280.

OPERATION OF THE PREFERRED EMBODIMENT

Referring again to FIGS. 2–5, tubing tester valve 17 of the present invention is run into a well bore as part of a testing or other pipe string. As tubing tester valve 17 is run in, it is in the position shown in FIGS. 2A and 2B, with valve flapper 136 resting on seat 146, mandrel 102 being in its retracted position with upper section 220 thereof below valve flapper 136.

As the pipe string continues into the well bore with the addition of more stands, the hydrostatic pressure of well bore fluid which has entered the open end of the pipe string will overcome the spring bias of valve flapper, opening it and thereby filling the pipe string thereabove until the hydrostatic head above valve flapper 136, in conjunction with the force of the flapper spring, approximates the hydrostatic pressure below valve flapper 136, whereupon it will again close and seat on top edge 148 of valve seat 146.

In such a manner, the pipe string above valve 17 can be pressure tested every few pipe stands to ascertain the presence of any leaks and remedy them without pulling dozens, or even hundreds, of stands out of the hole after reaching test or treatment depth.

When the pipe string has been run to its final depth to conduct a well service operation and a packer set or stabbed into therebelow, valve flapper 136 can be permanently opened and locked open so as to permit pumping down the pipe string, by applying pressure to the well bore annulus surrounding the pipe string. The increased pressure will enter tubing tester valve 17 through ports 184 in housing assembly 100, and act on the underside of piston section 230 of mandrel 102 on a cross-sectional area defined between trailing surface 248 of mandrel 102 and piston bore 178. Since the set packer seals off the well bore below the packer, and thus the bottom of the pipe string from the pressure increase, hydrostatic acts on the inside of the tool and thus downwardly against piston section 230 of mandrel 102 through apertures 258. Thus, shear pins 270 are assisted by the hydrostatic and do not have to be made overly strong, as would be the case if chamber 256 was at atmospheric (pressure) as in some prior art pressure-actuated shear pin type tools. When the pressure overcomes the shear strength of shear pins 270, mandrel 102 will move upward relative to housing assembly 100, arcuate edge 222 at the top of valve action section 220 contacting valve flapper 136 on its underside 150 at a point diametrically opposite hinge assembly 145 so as to provide the maximum possible initial opening moment against valve flapper 136.

Figure 3A:
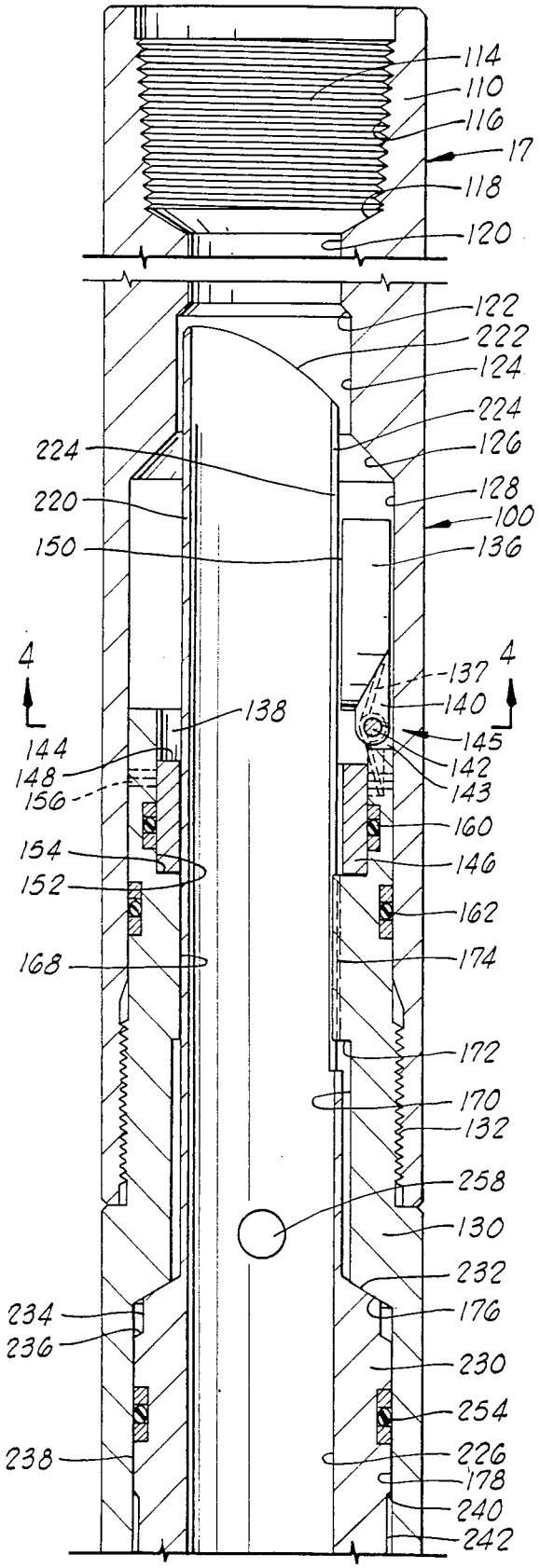
FIGS. 3A and 3B comprise a vertical half-section elevation of the preferred embodiment of the tubing tester valve of the present invention depicted in FIG. 2, after the mandrel assembly has been actuated to open the flapper valve employed therein.

As mandrel 102 continues its relative upward movement, valve flapper 136 will continue to ride on arcuate edge 222 as it rotated open into valve chamber 144 until it is substantially vertical, whereupon mandrel 102 continues upward past opened valve flapper 136 and into mandrel receptacle bore 124 (see FIG. 3A).

Figure 3B:
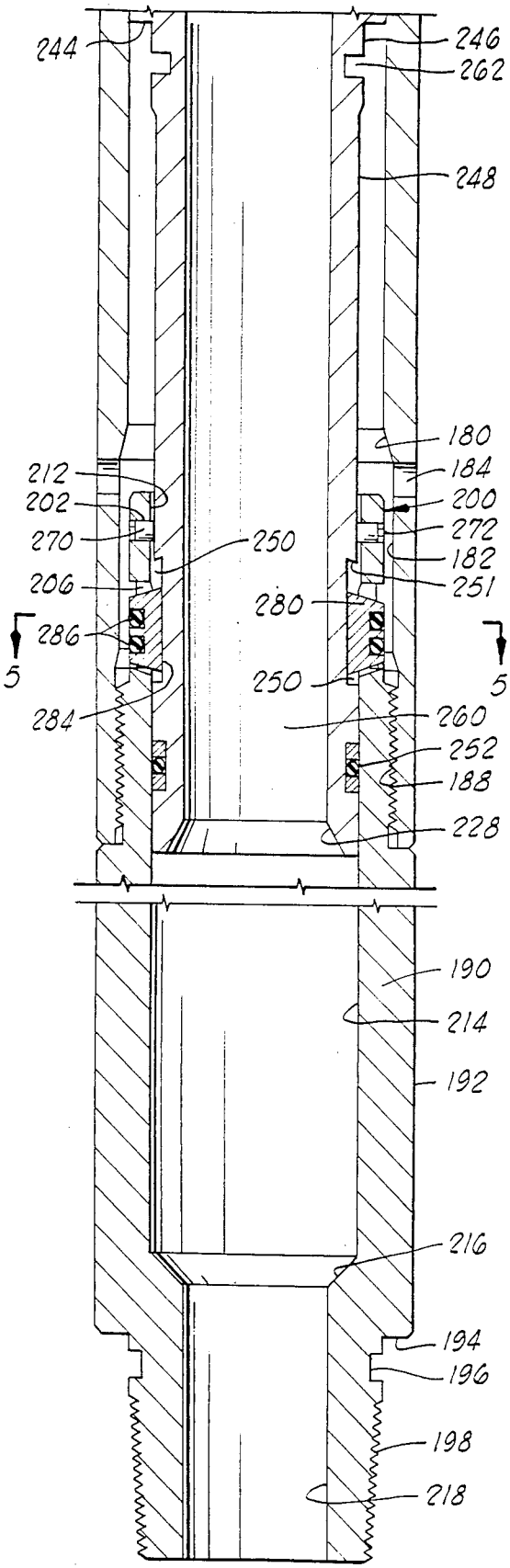
Figure 4:
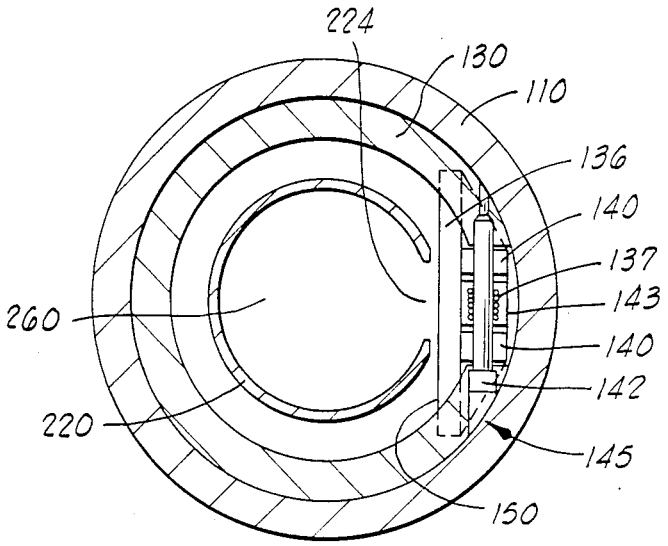
FIG. 4 is a section taken across lines 4—4 in FIG. 3A.

When mandrel 102 reaches the upper limit of its travel as restricted by contact of piston section 230 with annular surface 176 above piston bore 178, locking groove 250 is adjacent inwardly-biased locking dogs 280, which fall into groove 250 and are maintained therein by springs or O-rings 286 (see FIG. 3B). The trapezoidal shape of locking dogs 286, in conjunction with the undercut top edge 251 of locking groove 250, prevents locking dogs 280 from jumping out of groove 250 upon any application of downward force to mandrel 102, thus ensuring the locked-open position of valve flapper 136 as shown in FIG. 3A and permitting the pumping of fluids downwardly thereby without risk of flapper closure.

From the foregoing description of the preferred embodiment and its operation, it will be readily apparent to those of ordinary skill in the art that the tubing tester valve of the present invention constitutes a novel and unobvious solution to problems unsolved by the prior art and possessing many advantages thereover. For example, the present invention allows for safer running of testing tools and pipe, due to the relatively balanced pressures inside and outside the string, rendering it impossible for the pipe to "U-tube" or lose the hydrostatic pressure of the mud on the formation, as might be experienced with an empty or highly under-balanced string. This is particularly critical when no downhole formation tester valves are employed, as the formation blow out through the pipe string. In addition, the tool of the present invention can be placed immediately above the tubing seal assembly (see FIG. 1 and description thereof) to allow internal pressure testing of all tools, including downhole gauge carriers in the string, while running in. Rig time is also saved, as previously noted, by permitting continual testing of the pipe string during run-in, for early detection and easy remedying of leaks. The automatic filling of the pipe string through the tubing tester valve of the present invention saves time, as well as the handling of diesel or other fluid on the rig floor required when filling a string from the top. The present invention is of a relatively simple design, easy to prepare for operation and the use of a flapper valve instead of a ball valve ensures greater reliability for the applications in which the tool is employed, and easy, inexpensive replacement of the valve flapper and seat should that be necessary.

While the tubing tester valve of the present invention has been described in terms of a preferred embodiment, numerous additions, deletions and modifications thereto can be made without departing from the spirit and scope of the claimed invention.

I claim:

1. A method of pressure testing a pipe string in a well bore, comprising:

providing a pipe string having a tubing tester valve at the lower end thereof;

running said pipe string into said well bore;

filling the interior of said pipe string from below with well bore fluid through said tubing tester valve;

testing the integrity of said pipe string by applying pressure to the interior of said pipe string above said tubing tester valve thereagainst;

sealing across the annulus between said pipe string and the wall of said well bore below said tubing tester valve with a packer;

trapping hydrostatic pressure on the interior of said tubing tester valve in response to said sealing;

increasing the pressure in the well bore above said packer to open said tubing tester valve;

opposing said pressure increase with said trapped hydrostatic pressure; and opening said tubing tester valve only when the force resulting from said increased pressure exceeds the force resulting from said trapped hydrostatic pressure, to flow in said pipe string from above to below said tubing tester valve.

2. The method of claim 1, further including the steps of:

locking said tubing tester valve open;

releasing said increased pressure; and maintaining said tubing tester valve open in response to said locking after said pressure release.

* * * * *